US012228310B2

(12) United States Patent
Lai

(10) Patent No.: US 12,228,310 B2
(45) Date of Patent: Feb. 18, 2025

(54) APPARATUS FOR PROCESSING AIR IN AN INDOOR ENVIRONMENT

(71) Applicant: CITY UNIVERSITY OF HONG KONG, Kowloon (HK)

(72) Inventor: Chi Keung Lai, Kowloon (HK)

(73) Assignee: CITY UNIVERSITY OF HONG KONG, Kowloon (HK)

( * ) Notice: Subject to any disclaimer, the term of this patent is extended or adjusted under 35 U.S.C. 154(b) by 310 days.

(21) Appl. No.: 17/371,817

(22) Filed: Jul. 9, 2021

(65) Prior Publication Data

US 2022/0010992 A1 Jan. 13, 2022

Related U.S. Application Data

(60) Provisional application No. 63/050,179, filed on Jul. 10, 2020.

(51) Int. Cl.

| | |
|---|---|
| ***A61L 2/10*** | (2006.01) |
| ***F24F 7/007*** | (2006.01) |
| ***F24F 8/22*** | (2021.01) |

(52) U.S. Cl.

CPC ..... *F24F 8/22* (2021.01); *F24F 7/007* (2013.01)

(58) Field of Classification Search

CPC ..... F24F 8/22; A61L 9/20; A61L 2/10

See application file for complete search history.

(56) References Cited

U.S. PATENT DOCUMENTS

| | | | | |
|---|---|---|---|---|
| 2015/0196674 | A1* | 7/2015 | Newham | F21V 13/06 250/455.11 |
| 2016/0175475 | A1* | 6/2016 | DuPuis | A61L 9/20 250/504 R |
| 2018/0169279 | A1* | 6/2018 | Randers-Pehrson | A61N 5/0624 |
| 2019/0298869 | A1* | 10/2019 | Poulsen | F21S 8/063 |

* cited by examiner

*Primary Examiner* — Donald R Spamer

(74) *Attorney, Agent, or Firm* — Conley Rose, P.C.; Michael W. Piper; Andrew M. Metrailer

(57) ABSTRACT

A movable LED lamp that emits in the UV wavelength for germicidal purposes. The LED lamp can be mounted near the ceiling such that air in a room can be disinfected. Movements of the LED lamp sweeps the air near the ceiling in ultraviolet germicidal irradiation, which kills both bacteria, virus, fungi, and other bioaerosols. A poorly ventilated room can be disinfected more readily with such a sweeping system.

8 Claims, 10 Drawing Sheets

APPARATUS FOR PROCESSING AIR IN AN INDOOR ENVIRONMENT

CROSS-REFERENCE TO RELATED APPLICATIONS

This application claims priority under USC 35 119 to United States Provisional Application No. 63/050,179 filed in the United States Patent and Trademark Office on Jul. 10, 2020, entitled "AN APPARATUS FOR PROCESSING AIR IN AN INDOOR ENVIRONMENT", which is incorporated herein by reference in its entirety for all purposes.

FIELD OF INVENTION

The present invention relates to devices for sterilising airborne microbial organisms. In particular, the invention relates to ultraviolet germicidal irradiation and related devices

BACKGROUND OF THE INVENTION

Person-to-person transmission of airborne pathogens is one of the modes of transmission in many human outbreaks, such as tuberculosis (TB), smallpox, measles, SARS, MERS, and avian and swine influenza. Such outbreaks not only lead to an increased likelihood of epidemics. Therefore, microbial content of indoor air directly affects the health of people who spend the majority of their time in indoor environments in the company of other people.

Several methods have been proposed to clean air of microbes. One of the methods require use of high-efficiency particulate air (HEPA) filters. However, use of such filters require installation of large blocks of filters on the ceiling, and air has to be pumped through the filters with powerful engines. Therefore, HEPA filters are more suited for industrial applications such as in a clean room.

Another method applies ultraviolet (UV) germicidal irradiation to kill airborne pathogenic microorganisms. UV-induced mutagenic DNA lesions occurs primarily through the formation of pyrimidine dimers, and of other secondary photoproducts of genetic materials. This understanding shows that using UV for disinfection is a quick, efficient, safe and cost-effective process. In some applications, UV irradiation for infection control is configured as an upper-room ultraviolet germicidal irradiation (UR-UVGI). The typical UR-UVGI comprises low-pressure mercury-type UV-C lamp. However, mercury UV-C lamps are only about 30% efficient at converting input power into ultraviolet C (UV-C) radiation. Furthermore, ozone may be produced from the use of UV-C, which is harmful to people. Also, the devices are typically inflexibility in design and cannot be manufactured to emit UV over a wide range of wavelengths. Furthermore, lamp-based UR-UVGI fixture is huge and may be unsightly if many units may be required to disinfect a large room. Since only the upper-room air is irradiated, successful air disinfection relies on movement of air to bring the microorganism into the path of the ultra violet before the organisms can be killed. However, not all indoor environments are well-mixed conditions. In some environments, large air movements may not be convenient, such as places where people handle powders such as spice and so on.

Therefore, it is desirable to propose improved ultraviolet (UV) germicidal irradiation methods and devices which can improve disinfection of air in an indoor environment and, preferably, mitigate the need of ventilation to bring airborne microorganism into the germicidal irradiation.

SUMMARY OF THE INVENTION

In the first aspect, the invention proposes A method of disinfecting indoor air comprising the steps of: directing a germicidal electromagnetic radiation onto the overhead space in a room; moving the germicidal electromagnetic radiation across the overhead space.

Therefore, invention provides the possible advantage that the reach of germicidal electromagnetic radiation is physically wider and further, when compared to prior art wherein the germicidal electromagnetic radiation is stationary. There is no need, or less need, of ventilation and air movements to bring airborne microorganisms into the path of the germicidal electromagnetic radiation.

Preferably, the step of moving the germicidal electromagnetic radiation across the overhead space comprises: rotating a beam of the germicidal electromagnetic radiation across the overhead space. This feature has the further advantage that rotation can cover a while angle and therefore may sweep over a large cross section of the air space.

Optionally, the step includes moving a beam of the germicidal electromagnetic radiation about an axis which is vertical to the ground. Preferably, the beam is tiled in an upward angle. In this case, the tilting prevents the beam from accidentally getting into the eyes of people below the beam of the germicidal electromagnetic radiation.

Alternatively, the step includes moving a beam of about a the germicidal electromagnetic radiation n axis which is horizontal to the ground. This has a possibility of projecting the germicidal electromagnetic radiation onto the ceiling, which is good for eradicating fungal growth on the ceiling, as well as killing insects and spiders that tend to lurk on ceilings or in corners near the ceiling.

Preferably, the germicidal electromagnetic radiation is UV-C. However, other suitable the germicidal electromagnetic radiation is within the contemplation of this application, such as other UV wavelengths including UV-A, UV-B, which may be effective for specific microorganisms.

Optionally, the method further comprises the steps of moving air in the overhead space with a fan; wherein the fan moves with the movement of the germicidal electromagnetic radiation. This allows ventilation of the room to be improved together with moving the germicidal electromagnetic radiation.

In a second aspect, the invention proposes a device for disinfecting indoor air comprising a source of germicidal electromagnetic radiation; the source mounted to rotate about a pivotal point. Therefore, the invention provides a possibility of a moving source germicidal electromagnetic radiation, which relieves the room of having to be ventilated or fanned all the time in order for the germicidal electromagnetic radiation to kill as much microorganisms as possible.

Typically, the source of germicidal electromagnetic radiation comprises at least one light emitting diode. Preferably, the germicidal electromagnetic radiation is UV-C.

Preferably, the device further comprises a fan capable of moving about the pivot along with the movement of the source of germicidal electromagnetic radiation; such that the fan is directed to move air in the path of the germicidal electromagnetic radiation.

In a further aspect, the invention proposes a room having a source of germicidal electromagnetic radiation; wherein the source of germicidal electromagnetic radiation is capable of moving to project germicidal electromagnetic radiation across the room. The room can be a typical room for habitation such as a living room. However, other rooms can also benefit from the invention, such as the ceiling of a biological laboratory, which may have escaped viruses or pathogens in the air that should be eliminated by germicidal electromagnetic radiation.

Preferably, the source of germicidal electromagnetic radiation is LED. Preferably, the germicidal electromagnetic radiation is UV-C.

In the market all wall mounted disinfection devices are fixed to a wall stationarity. Most of them use conventional low pressure mercury lamp for the disinfection sources. The invention as claimed provides the possibility of a rotating platform for mounting UVC-LED for indoor pathogen disinfection.

In experiments and prototypes, comparisons have been made between rotating and stationary platforms under for two different emission scenarios; well mixed and poorly mixed. Same irradiation intensity were used for all four scenarios. The results shows that a rotating the UR-UVGI-LED system of one of the embodiments used in a poorly-mixed atmosphere condition, compared to the stationary system, has enhanced performance by 73%.

Accordingly, the invention makes it possible to offer a rotating platform of UVC-LED as commercial products. In practice, the number of LEDs can be selected according to the intended size of the room where the products are deployed. Rotating speed (angle per min) can be adjusted according to the dimensions of the room.

DRAWINGS

It will be convenient to further describe the present invention with respect to the accompanying drawings that illustrate possible arrangements of the invention, in which like integers refer to like parts. Other arrangements of the invention are possible, and consequently the particularity of the accompanying drawings is not to be understood as superseding the generality of the preceding description of the invention.

Figure 1:
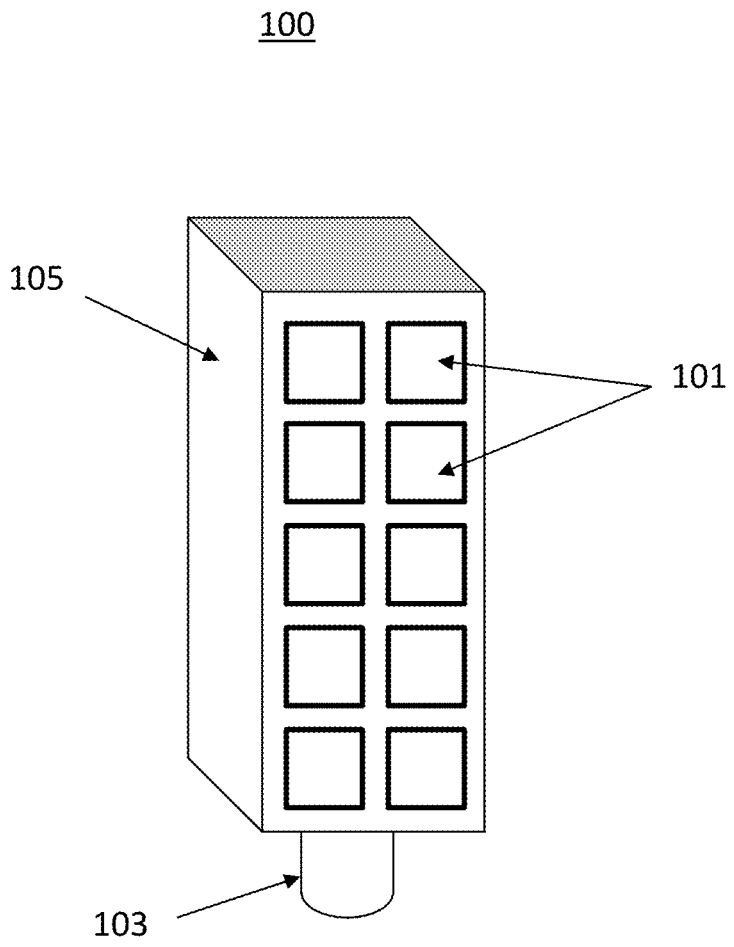
FIG. 1 illustrates a first embodiment.
Figure 5:
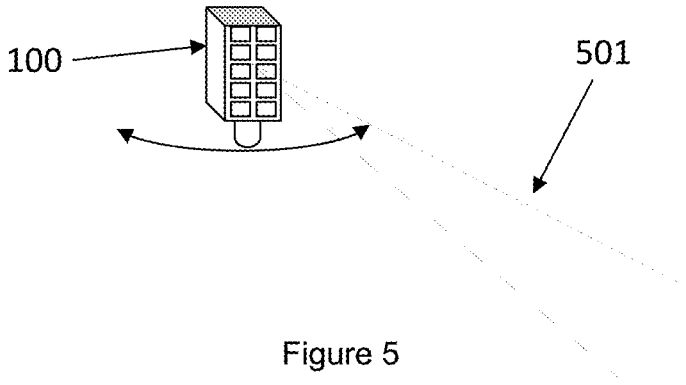
Figure 6:
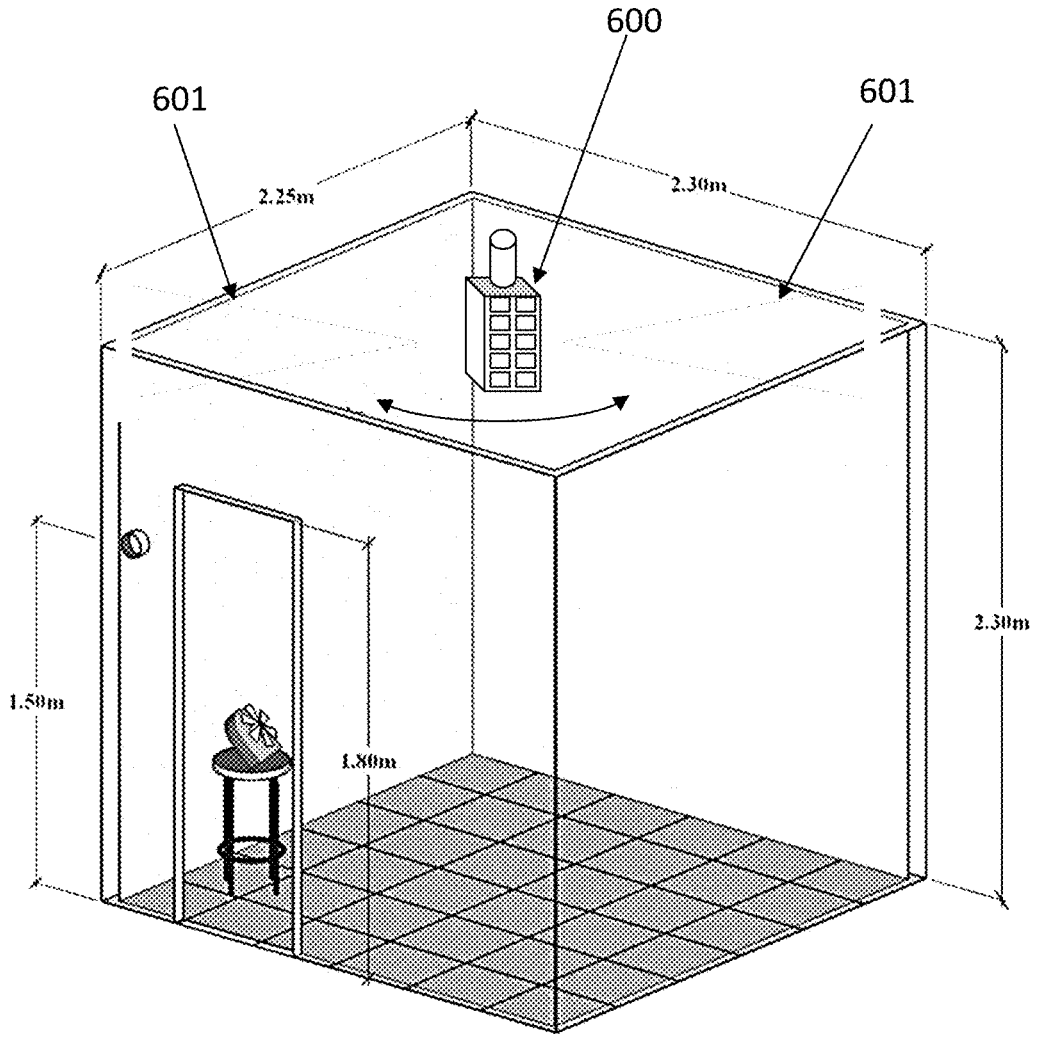
Figure 7:
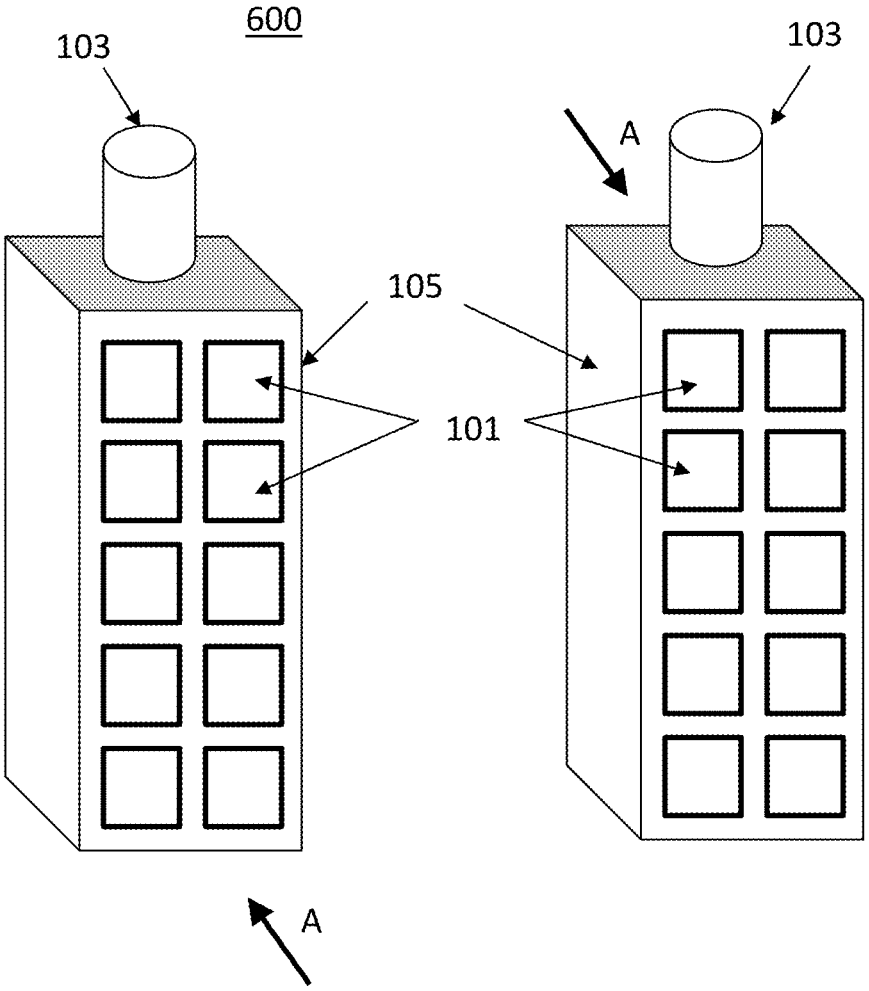
Figure 8:
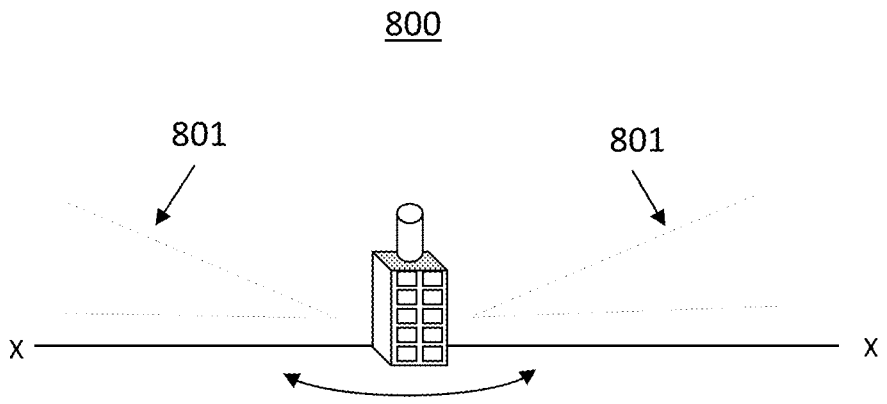
Figure 9:
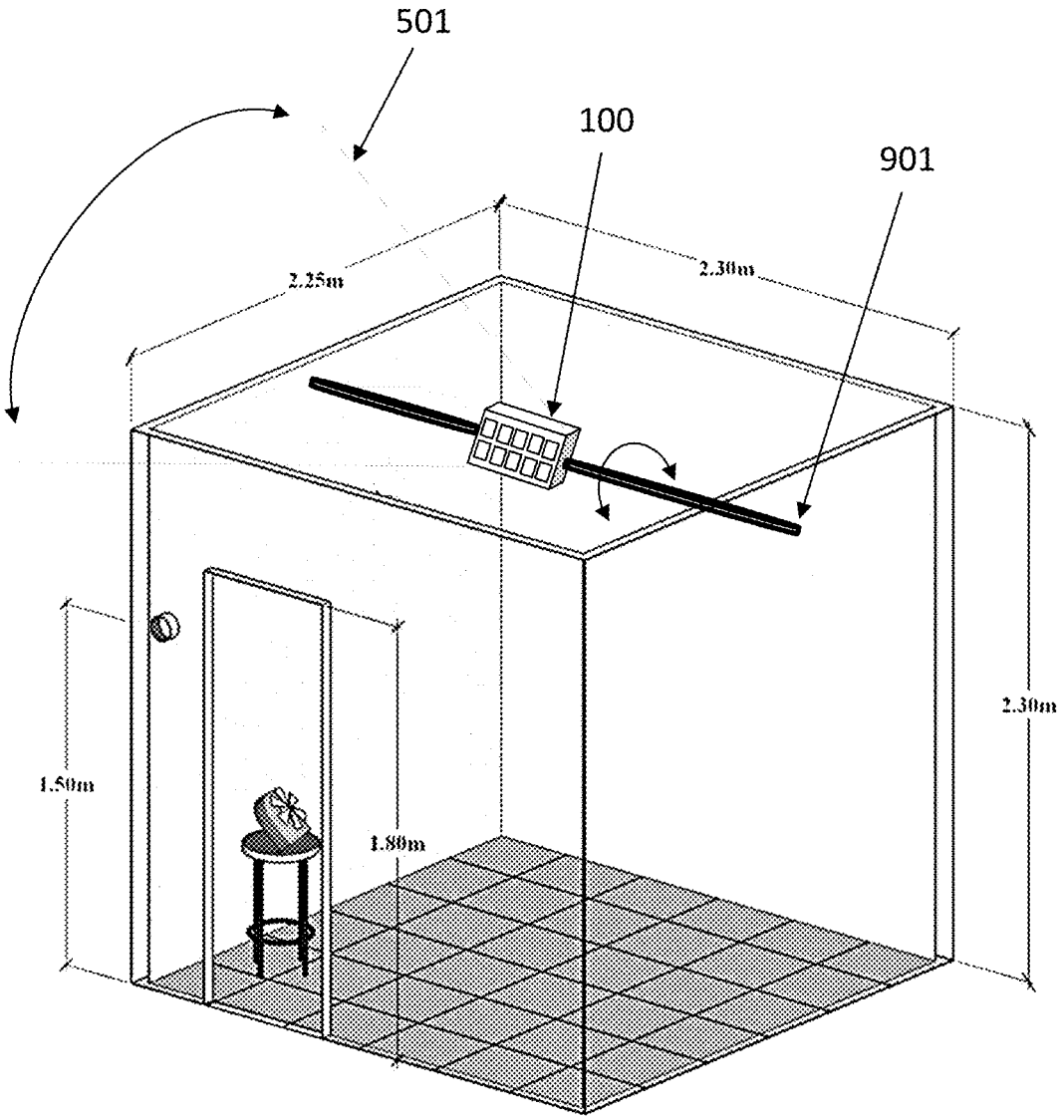
Figure 10:
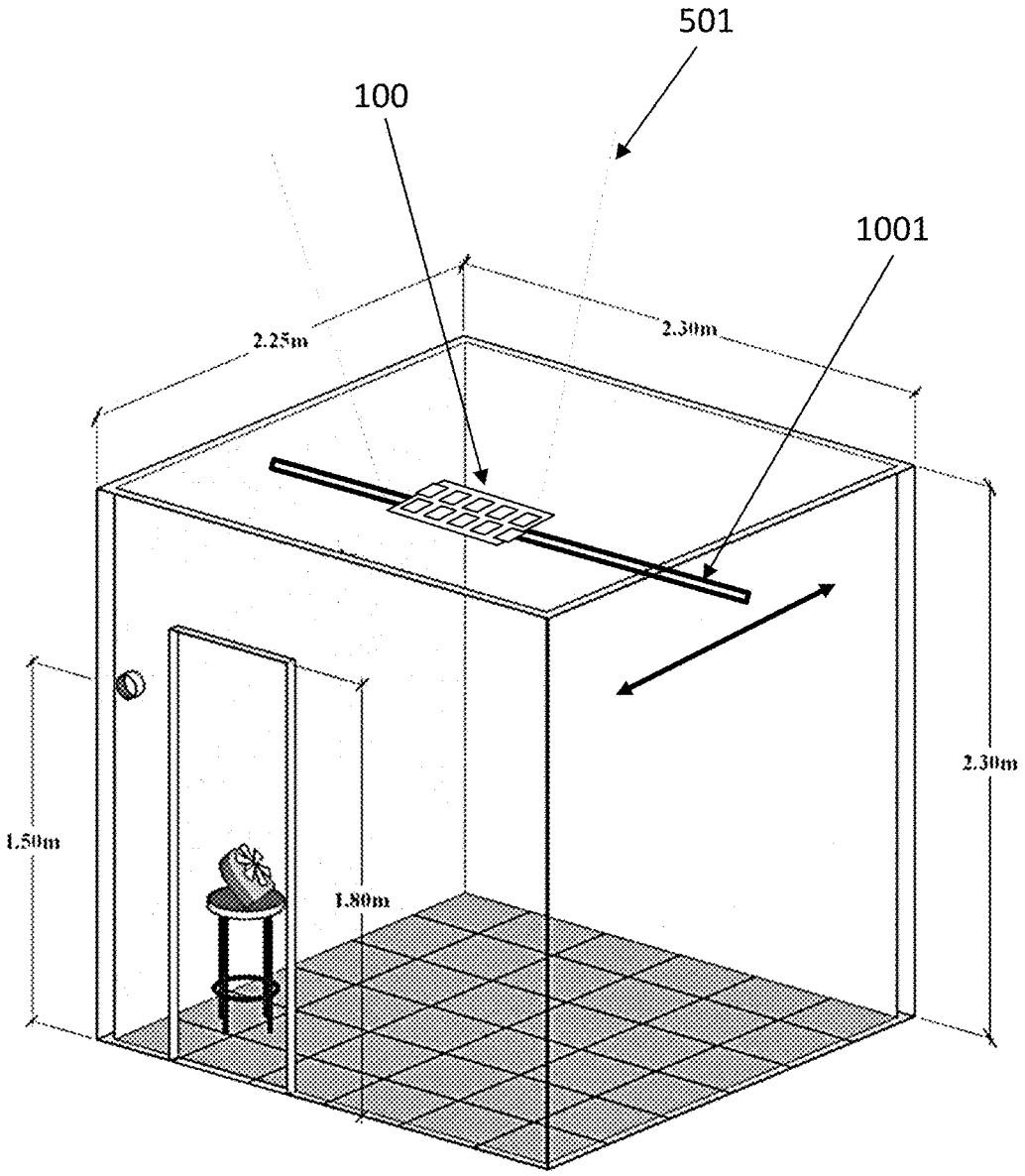

FIG. 5 further illustrates how the embodiment of FIG. 1 may normally be used;

FIG. 6 shows a second embodiment;

FIG. 7 illustrates the second embodiment of FIG. 6 in greater detail;

FIG. 8 shows a variation of the embodiment of FIG. 7;

FIG. 9 shows a third embodiment;

FIG. 10 shows a fourth embodiment; and

Figure 11:
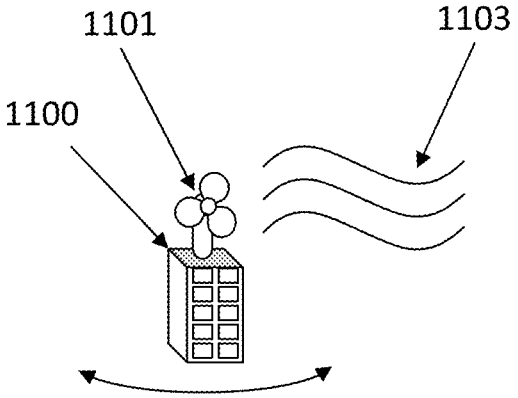

FIG. 11 shows a fifth embodiment.

DETAILED DESCRIPTION OF SPECIFIC EMBODIMENTS

FIG. 1 shows a schematic diagram of an embodiment of the present invention. The embodiment is a germicidal lamp 100 (called UR-UVGI-LED system further down in this description) which comprises at least one light emitting diode (LED) 101 that can emit ultra violet C light, i.e. UV-C.

In FIG. 1, ten diodes 101 are shown arranged in two columns of five diodes 101 on a housing 105. UV-C rays or beams emitted by the LEDs can be used to disinfect air that passes into the path of the beams. The embodiment is mounted on a pivot 103 so that the germicidal lamp 100 can rotate about a pivotal point 103.

Typically, a germicidal lamp is an electric light that produces ultraviolet C (UV-C) light. As the skilled man knows, wavelengths between about 200 nm and 300 nm are strongly absorbed by nucleic acids, creating defects such as pyrimidine dimers. These dimers can prevent replication or can prevent the expression of necessary proteins, resulting in the death or inactivation of inactivation of bacteria, viruses, and protozoa.

Figure 3:
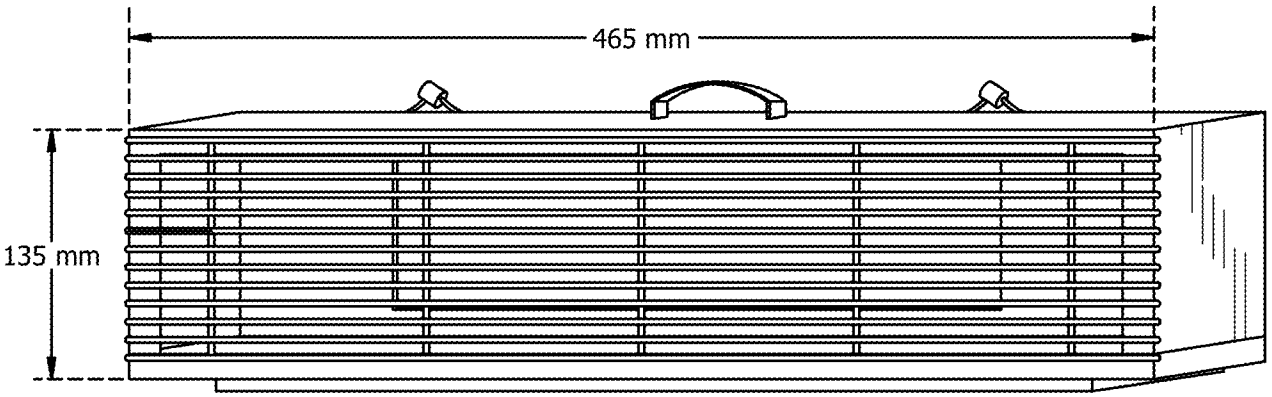
FIG. 3 is a comparative example of a prior art to the embodiment of FIG. 1.

The common types of prior art germicidal lamps include low-pressure mercury lamps and high-pressure mercury lamps. FIG. 3 shows such a mercury lamp. It can be seen easily that a mercury lamp is bulky. Therefore the mercury lamp is not amenable to being moved and tends to be fixed in location and position. Thus, mercury lamps are only useable in rooms that are well ventilated, such that airborne microorganisms in bioaerosols may flow into the path of the UV light and be killed. Bioaerosols can transmit microbial pathogens, endotoxins, and allergens to which humans are sensitive, and is responsible for transmission of meningococcal meningitis and tuberculosis.

Figure 2:
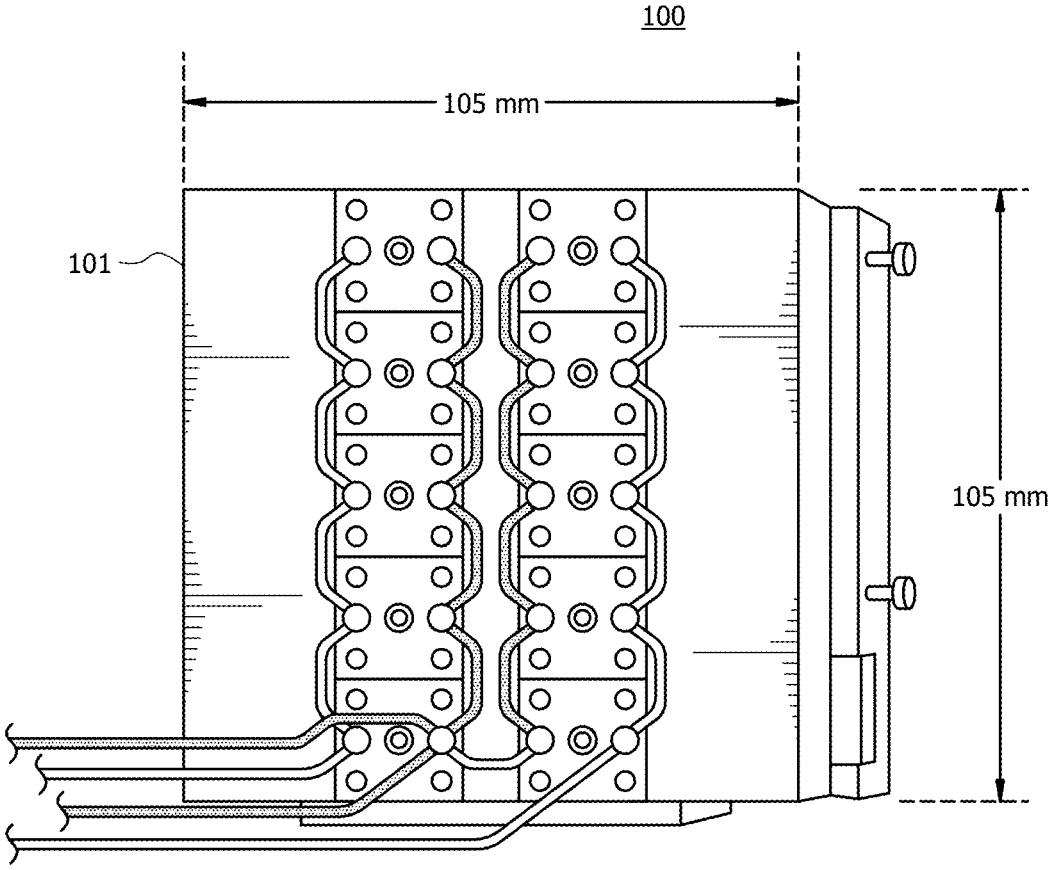
FIG. 2 is a photograph of a prototype according to the embodiment of FIG. 1.

FIG. 2 is a photograph of a prototype according to the embodiment of FIG. 1. The diodes can be seen arranged in two columns of 5 diodes each. Typically, the rated output intensity of each LED is >20 mW and the rated current was 350 mA. Hence the total rated input current was 3.5 A. The array of the LEDs was fixed onto a heat sink. The UV wavelengths emitted by the 10 LEDs were in the ultraviolet C band, i.e. 263-271 nm.

In use, the diodes can be operated with varying input currents of 0.3, 0.6, and 3.5 amperes, which yields average irradiances of 0.316 $\mu W/cm^2$ (range, 0.16-2.67 $\mu W/cm^2$), 0.382 $\mu W/cm^2$ (range, 0.21-3.52 $\mu W/cm^2$), and 0.517 $\mu W/cm^2$ (range, 0.25-5.73 $\mu W/cm^2$).

Figure 4:
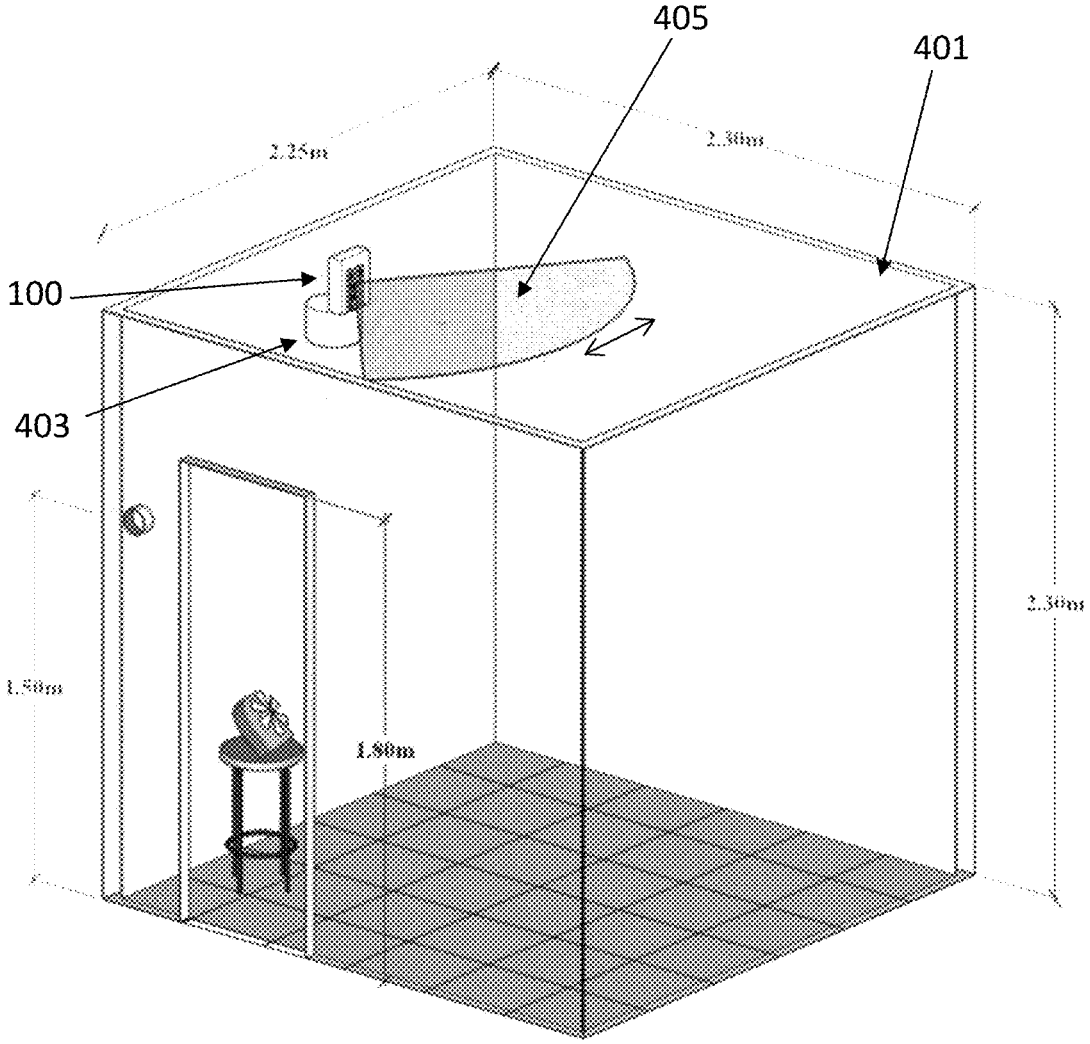
FIG. 4 illustrates how the embodiment of FIG. 1 may be used.

FIG. 4 shows the germicidal lamp 100 mounted in a room 401. Preferably, the germicidal lamp 100' is installed on the upper portion of a wall or near the ceiling. Hence, the germicidal lamp 100 may be called an "upper room ultraviolet germicidal irradiation system", i.e. a UR-UVGI-LED system.

The pivot of the germicidal lamp 100 is fitted to an electrically-driven rotating platform 403, which can rotate horizontally (left and right) to sweep the air near the ceiling across 180 degrees. The time required to rotate the germicidal lamp 100 back and forth through 180 degrees preferably takes about one minute to complete (6 degrees per second). Based on the strength of the currently available UV LEDs, the germicidal lamp 100 creates a horizontal irradiated zone 405 in the air of about 0.29 m from the diodes. In this way, a beam of UV-C light is directed to disinfect air above the heads of people in the room.

Alternatively, the germicidal lamp 100 is hung on the wall at a height of 2 m to 3 m from the ground. This is because, if the room has a very high ceiling, then disinfection of the room should not be made too high above the people. 2 m to 3 m is a good height as the UV-C is able to disinfect air not too high up over the heads of people. This means that the air disinfection effect can benefit people more immediately.

FIG. 5 illustrates how the germicidal lamp 100 projects a beam 501 of UV-C light forwardly, such that the germicidal lamp 100 may be mounted on a wall as shown in FIG. 4 to project the beam 501 across the room 401.

FIG. 6 and FIG. 7 show another germicidal lamp 600 in which there are LEDs arranged on two opposite faces on the housing 105. The facing of the germicidal lamp 100 in this case can be identified by the arrow marked A. In this way, the LEDs are capable of projecting UV beams 601 to two different directions, and the germicidal lamp 100 can be mounted to the ceiling in the centre of the room. The pivot is on the top of the housing 105 of the LEDs in this germicidal lamp to allow the germicidal lamp to be ceiling mounted. The electric motor for rotating the germicidal lamp 600

FIG. 8 is a similar germicidal lamp 800 to that of FIG. 6 and FIG. 7, except that the LEDs in the germicidal lamp 100 are arranged such that the beams 801 are slightly tilted upwardly, above the horizontal line XX, to avoid the edge of the beams 801 projecting downwardly into the eye of people below the ceiling.

FIG. 9 shows the germicidal lamp 100 of FIG. 1 mounted on a horizontal elongated member 901 that allows the projection from the germicidal lamp 100 to be rotated about the horizontal elongated member, and the rotation causes the UV-C light to sweep across the ceiling. This embodiment has the advantage that the UV-C light is unlikely to catch the eye of people beneath the germicidal lamp 100. Furthermore, fungi and algae on the ceiling can be eradicated, especially if the is seepage in the ceiling. Which encourage the growth of fungi or algae. Also, insects and spiders which tend to hide in corners between ceiling and walls may also be eradicated.

FIG. 10 shows another way the germicidal lamp 100 of FIG. 1 can be installed, which is on a slidable horizontal elongated member 1001, the ends of which are connected to sliding tracks (not illustrated) on opposite walls of the room. This germicidal lamp allows the germicidal lamp 100 to move across the ceiling while projecting the UV-C light towards the ceiling. Designs and mechanisms for moving horizontal elongated member in sliding tracks are known and need not be explained in detail here.

FIG. 11 shows yet another germicidal lamp 1100, in which a fan 1101 is secured to the top of the housing of the germicidal lamp 1100. This allows air in the room shown in FIG. 4 to be ventilated as the germicidal lamp rotates, increasing the change of bioaerosols being swept up about the room and to flow into the path of the UV-C light to be eradicated.

The embodiments have demonstrated that, advantageously, UV-C-LEDs, due to their potential to be configured in a wide range of sizes and geometries, can be applied to make a rotating UV irradiation system. By moving the light source, it is less critical that the room have very good ventilation. Some corners may entrap eddy currents in which air which cannot be exchanged as the air are stuck in the corners.

Therefore, the embodiments include A method of disinfecting indoor air comprising the steps of: directing a germicidal electromagnetic radiation onto the overhead space in a room; moving the germicidal electromagnetic radiation across the overhead space.

Furthermore, the embodiments include a device for disinfecting indoor air comprising a source of germicidal electromagnetic radiation; the source mounted to rotate about a pivotal point.

Furthermore, the embodiments include a room having a source of germicidal electromagnetic radiation; wherein the source of germicidal electromagnetic radiation is capable of moving to project germicidal electromagnetic radiation across the room.

While there has been described in the foregoing description preferred embodiments of the present invention, it will be understood by those skilled in the technology concerned that many variations or modifications in details of design, construction or operation may be made without departing from the scope of the present invention as claimed.

Experiments

The system as described in FIG. 2 and FIG. 4 was installed in the upper level of the chamber having dimensions shown in FIG. 4. The effectiveness of the system against aerosolized *E. coli, S. marcescens*, and *S. epidermidis* under well-mixed and stationary scenario were initially tested. The estimated susceptibility values were 1.068, 1.148, and 0.156 m2/J for *E. coli, S. marcescens*, and *S. epidermidis*, respectively.

Three additional scenarios of experiments were conducted, in which *E. coli* was aerosolized into the test chamber and then allowed to decay under (i) poorly-mixed condition with stationary system, (ii) well-mixed with rotating system, and (iii) poorly-mixed conditions with rotating system.

Results showed no significant difference between the performance of stationary and rotating germicidal lamp 100*s* under a well-mixed condition. While the performance of the stationary germicidal lamp 100 under a poorly-mixed condition decreased by 52.90-79.38% compared to a well-mixed condition, rotating the germicidal lamp 100 under a poorly-mixed condition, compared to the stationary system, enhanced its performance by 22.36-49.86%. Thus, our proposed rotating irradiation offers great potential for application in environments where bioaerosols are unevenly distributed in a built environment.

The invention claimed is:

1. A method of disinfecting indoor air in a room occupied by at least one person comprising the steps of:

providing a source of germicidal electromagnetic radiation in the room;

locating the source at a height over the head of the at least one person;

the source emitting a beam of germicidal electromagnetic radiation at an upward angle onto the overhead space in the room;

moving or rotating the germicidal electromagnetic radiation across the overhead space while maintaining the beam at an upward angle so as not to project downwardly into an eye of the at least one person.

2. The method of disinfecting indoor air in the room occupied by at least one person as claimed in claim 1, wherein the source is at a height less than 3 metres.

3. The method of disinfecting indoor air in the room occupied by at least one person as claimed in claim 1, wherein the rotation of the germicidal electromagnetic radiation occurs about an axis which is vertical to the ground.

4. The method of disinfecting indoor air in the room occupied by at least one person as claimed in claim 1, wherein the rotation of the germicidal electromagnetic radiation occurs about an axis which is horizontal to the ground.

5. The method of disinfecting indoor air in the room occupied by at least one person as claimed in claim 1, wherein the germicidal electromagnetic radiation is UV-C.

6. A system comprising:

a room; and a device for disinfecting indoor air in a room comprising:

a source of germicidal electromagnetic radiation; wherein the source is mounted on a wall of the room;

the source providing a beam of germicidal electromagnetic radiation configured to point in an upward angle; and the source being able to move the beam across the room while maintaining the beam at an upward angle so as not to project downwardly.

7. The system as claimed in claim 6, wherein the source of germicidal electromagnetic radiation comprises at least one light emitting diode.

8. The system as claimed in claim 6, wherein the germicidal electromagnetic radiation is UV-C.

* * * * *